US011304540B1

(12) United States Patent
Rant et al.

(10) Patent No.: US 11,304,540 B1
(45) Date of Patent: Apr. 19, 2022

(54) BABY CARRIER DEVICE

(71) Applicant: Tamara Edlin Rant, Walnut Creek, CA (US)

(72) Inventors: Tamara Edlin Rant, Walnut Creek, CA (US); Alisa DeMarco, Grayslake, IL (US)

( * ) Notice: Subject to any disclaimer, the term of this patent is extended or adjusted under 35 U.S.C. 154(b) by 0 days.

(21) Appl. No.: 17/318,667

(22) Filed: May 12, 2021

(51) Int. Cl.
*A47D 13/02* (2006.01)
*A45F 3/14* (2006.01)

(52) U.S. Cl.
CPC ..... *A47D 13/025* (2013.01); *A45F 3/14* (2013.01); *A45F 2003/142* (2013.01)

(58) Field of Classification Search
CPC ..... A47D 13/025; A45F 3/14
USPC ..... 224/159
See application file for complete search history.

(56) References Cited

U.S. PATENT DOCUMENTS 4,234,229 A * 11/1980 Arnold ..... A47D 13/025 224/160
4,836,428 A * 6/1989 Evans ..... A45C 1/04 224/240
4,986,458 A * 1/1991 Linday ..... A47D 13/025 224/160
7,252,214 B2 * 8/2007 Krogh ..... A47D 13/025 224/158
7,614,533 B2 * 11/2009 Boal ..... A47D 13/025 224/159
7,766,199 B1 * 8/2010 Caperon ..... A47D 13/025 224/160
8,172,116 B1 * 5/2012 Lehan ..... A47D 13/025 224/160
8,424,732 B1 * 4/2013 Lehan ..... A45F 3/04 224/160
8,701,949 B1 * 4/2014 Lehan ..... A47D 13/025 224/160
8,783,530 B1 * 7/2014 Jordan ..... A47D 13/025 224/159
9,314,113 B1 * 4/2016 Lehan ..... A47D 13/025
9,700,152 B2 * 7/2017 Telford ..... A47D 13/025
10,271,663 B2 * 4/2019 Salazar ..... A47D 13/025
D864,557 S * 10/2019 Sales ..... D3/214
10,441,090 B2 * 10/2019 Lehan ..... A47D 13/025
10,441,091 B2 * 10/2019 Salazar ..... A47D 13/025
2008/0087694 A1 * 4/2008 Meng ..... A47D 13/025 224/160

(Continued)

*Primary Examiner* — Nathan J Newhouse
*Assistant Examiner* — Lester L Vanterpool
(74) *Attorney, Agent, or Firm* — Michael D. Eisenberg

(57) ABSTRACT

A baby carrier device configured to secure a baby an upper body of the person, and comprising a support pad, shoulder straps, and at least one vertical strap. The support pad is configured for receiving and supporting at least an upper body of the baby, and extends substantially vertically between a top end and a bottom end thereof and substantially horizontally between lateral sides thereof. The shoulder straps are joined to the support pad, and configured to removably join the support pad to shoulders of the person carrying the baby. The vertical strap is located at or near the bottom of support pad, has a top portion and a bottom portion, the bottom portion extending below the bottom end of the support pad, the vertical strap being configured for encircling a hip seat worn by the person carrying the baby to removably join the baby carrier to the hip seat.

11 Claims, 11 Drawing Sheets

(56) References Cited

U.S. PATENT DOCUMENTS

| | | | | |
|---|---|---|---|---|
| 2008/0283559 | A1* | 11/2008 | Parness | A47D 13/025 224/159 |
| 2008/0283560 | A1* | 11/2008 | Parness | A47D 13/025 224/160 |
| 2008/0314940 | A1* | 12/2008 | Raz | A47D 13/025 224/161 |
| 2009/0078729 | A1* | 3/2009 | Coote | A47D 15/006 224/161 |
| 2009/0206116 | A1* | 8/2009 | Grant | A47D 13/025 224/160 |
| 2012/0043359 | A1* | 2/2012 | Bergkvist | A47D 13/025 224/160 |
| 2015/0136817 | A1* | 5/2015 | Schaarschmidt | A47D 13/025 224/159 |
| 2016/0227940 | A1* | 8/2016 | Wikner | A47D 13/025 |
| 2018/0206653 | A1* | 7/2018 | Andrus | A47D 13/025 |

* cited by examiner (General Art)

BABY CARRIER DEVICE

TECHNICAL FIELD

This invention relates to baby carrier devices to be worn by a person, so as to enable the person to carry a baby hands-free.

BACKGROUND OF THE INVENTION

Baby carrier devices have been used since the dawn of mankind to allow parents or caretakes to carry babies without the use of their hands, leaving the person carrying the baby free to use the person's arms and hands to perform a variety of activities while carrying a baby. The baby carrier device puts the strain of the baby's weight on the person's upper body (back, and/or chest, and/or shoulders).

As shown in FIG. 10, a hip seat 100 is a common device worn by a person around the person's hip area or waist area and having an extension 102 protruding away from the person's body to function as a seat for a baby. The hip seat supports a baby, but the person carrying the baby has to hold the baby with at least one hand to prevent the baby from falling from the hip seat. The hip seat puts at least some of the strain of the baby's weight on the person's hip and waist area.

BRIEF SUMMARY OF EMBODIMENTS OF THE INVENTION

Because the hip seat still requires the person to hold the baby, the inventor of the present invention has found that it would be advantageous to combine a hands-free baby carrier device with the hip seat to provide a comfortable seat to the baby (an advantage provided by the hip seat) while allowing the person carrying the baby to have free hands (an advantage provided by the baby carrier device).

The inventor, however, has found that such combination is not always comfortable, as relative movement between the baby carrier device and the hip seat can cause discomfort to the baby and the person carrying the baby, as the baby's weight easily shifts unpredictably between the hip seat and the baby carrier device. This causes unpredictable changes of strain on the person's hip/waist area and on the person's upper body, when the person or the baby moves.

To overcome the above issue, the inventor has invented a hands-free baby carrier device that can be used alone and can also be detachably joined to a hip seat. The joining of the baby carrier device to the hip seat decreases the movement of the baby carrier device relative to the hip seat. In this manner, the change in the distribution of the strain caused by the baby's weight is decreased even as the baby or person carrying the baby moves.

Therefore, an aspect of some embodiments of the present invention relates to a baby carrier device configured to be worn by a person to secure a baby an upper body of the person. The baby carrier device comprises a support pad, shoulder straps, and at least one vertical strap. The support pad is configured for receiving and supporting at least an upper body of the baby, and extends substantially vertically between a top end and a bottom end thereof and extending substantially horizontally between lateral sides thereof. The shoulder straps are joined to the support pad, and are configured to removably join the support pad to shoulders of the person carrying the baby. The at least one vertical strap is located at or near the bottom of support pad, the vertical strap having a top portion and a bottom portion, the bottom portion extending below the bottom end of the support pad, the vertical strap being configured for encircling a portion of a hip seat worn by the person carrying the baby by removably connecting the top portion to the bottom portion, to removably join the baby carrier to the hip seat.

In a variant, the baby carrier device of claim 1, comprises a waist channel extending horizontally and located at a bottom portion of the support pad, the waist channel having at least a first top aperture and first bottom aperture, first bottom aperture being located below the first top aperture. The at least one vertical strap is disposed in the waist channel. The at least one vertical strap is configured to be removable from the waist channel via the first top aperture and/or the second aperture. The first top aperture and the first bottom aperture form a vertical channel traversed by the at least one vertical strap.

In a variant, the waist channel has a second top aperture and second bottom aperture, the second bottom aperture being located below the second top aperture. The baby carrier device comprises a second vertical strap dispose in the waist channel. The second vertical strap is configured to be removable from the waist channel via the second top aperture and/or the second bottom aperture. The second top aperture and the second bottom aperture form a second vertical channel traversed by the second vertical strap.

In another variant, the at least one vertical strap comprises a plurality of vertical straps.

In some embodiments of the present invention, the baby carrier device comprises a waist belt joined to the support pad at or near the bottom end of the support pad, the waist belt extending horizontally from the lateral sides of the support pad and being configured to encircle a waist of the person carrying the baby in order to removably join a portion of the support pad at or near the bottom end to the waist of the person carrying the baby.

In a variant, the baby carrier device comprises a waist channel extending horizontally and located at a bottom portion of the support pad, the waist channel having at least a first top aperture and first bottom aperture, first bottom aperture being located below the first top aperture. The at least one vertical strap traverses at least a portion of the waist channel via the first top aperture and the first bottom aperture. The at least one vertical strap is removable from the waist channel via the first top aperture and/or the second aperture. The first top aperture and the first bottom aperture form a vertical channel traversed by the at least one vertical strap. The waist channel comprises a first side opening and a second side opening substantially horizontally aligned with each other. The waist belt traverses at least a portion of the waist channel via the first side opening and the second side opening, to be joined the waist channel. The waist belt is removable from the waist channel via the first side opening and the second side opening.

In another variant, the first side opening is at a first lateral end of the waist channel and the second side opening is at a second lateral end of the waist channel.

In some embodiments of the present invention, the baby carrier device comprises lateral connectors joined to the support pad. The shoulder straps comprise respective first connectors. Each of the first connectors of the shoulder straps is configured is configured to be joined to either lateral connector, to join the shoulder straps to the shoulders of the person carrying the baby.

In a variant, each shoulder strap is near a respective lateral side, and the first connector of each shoulder strap is configured to be joined to the lateral connector closer to the lateral side of the shoulder strap, so as to create a closed loop over a corresponding shoulder of the person carrying the baby.

In another variant, each shoulder strap is near a respective lateral side, and the first connector of each shoulder strap is configured to be joined to the lateral connector farther from the lateral side of the shoulder strap, so as to create a closed loop over a back of the person carrying the baby.

Another aspect of some embodiments of the present invention relates to a baby carrier device configured to be worn by a person to secure a baby an upper body of the person, the baby carrier device comprising: a support pad configured for receiving and supporting at least an upper body of the baby, the support pad extending substantially vertically between a top end and a bottom end thereof and extending substantially horizontally between lateral sides thereof; shoulder straps joined to the support pad, the shoulder straps being configured to removably join the support pad to shoulders of a person carrying the baby; at least one vertical strap located at or near the bottom end of support pad, the vertical strap having a top portion and a bottom portion, the bottom portion extending below the bottom end of the support pad, the vertical strap being configured for encircling a portion of a hip seat worn by the person carrying the baby by removably connecting the top portion to the bottom portion together, to removably join the baby carrier device to the hip seat; a waist channel extending horizontally and located at a bottom portion of the support, the waist channel having at least a first top aperture, first bottom aperture, a first side opening and a second side opening. The first top aperture is located above the first bottom aperture. The first top aperture and the first bottom aperture form a first vertical channel. The first side opening and the second side opening substantially horizontally aligned with each other. The at least one vertical strap traverses the first vertical channel via the first top aperture and the first bottom aperture. The at least one vertical strap is removable from the waist channel via the first top aperture and/or the second aperture. The waist belt traverses at least a portion of the waist channel via the first side opening and the second side opening. The waist belt is removable from the waist channel via the first side opening and the second side opening.

In a variant, the waist channel has a second top aperture and second bottom aperture, the second bottom aperture being located below the second top aperture. The first top aperture and the first bottom aperture form a second vertical channel. The baby carrier device comprises a second vertical strap traversing second vertical channel via the second top aperture and the second bottom aperture. The second vertical strap is removable from the waist channel via the second top aperture and/or the second aperture.

Yet another aspect of some embodiments of the present invention relates to a baby carrier device configured to be worn by a person to secure a baby an upper body of the person, the baby carrier device comprising: a support pad configured for receiving and supporting at least an upper body of the baby, the support pad extending substantially vertically between a top end and a bottom end thereof and extending substantially horizontally between lateral sides thereof; shoulder straps joined to the support pad, the shoulder straps being configured to removably join the support pad to shoulders of a person carrying the baby; at least one vertical strap located at or near the bottom end of support pad, the vertical strap having a top portion and a bottom portion, the bottom portion extending below the bottom end of the support pad, the vertical strap being configured for encircling a portion of a hip seat worn by the person carrying the baby by removably connecting the top portion to the bottom portion together, to removably join the baby carrier device to the hip seat; a vertical channel located at a bottom portion of the support pad, the vertical channel having at least a first top aperture and a first bottom aperture. The first top aperture is located above the first bottom aperture. The at least one vertical strap is disposed in and traverses the vertical channel via the first top aperture and the first bottom aperture. The at least one vertical strap is removable from the vertical channel via the first top aperture and/or the second aperture.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
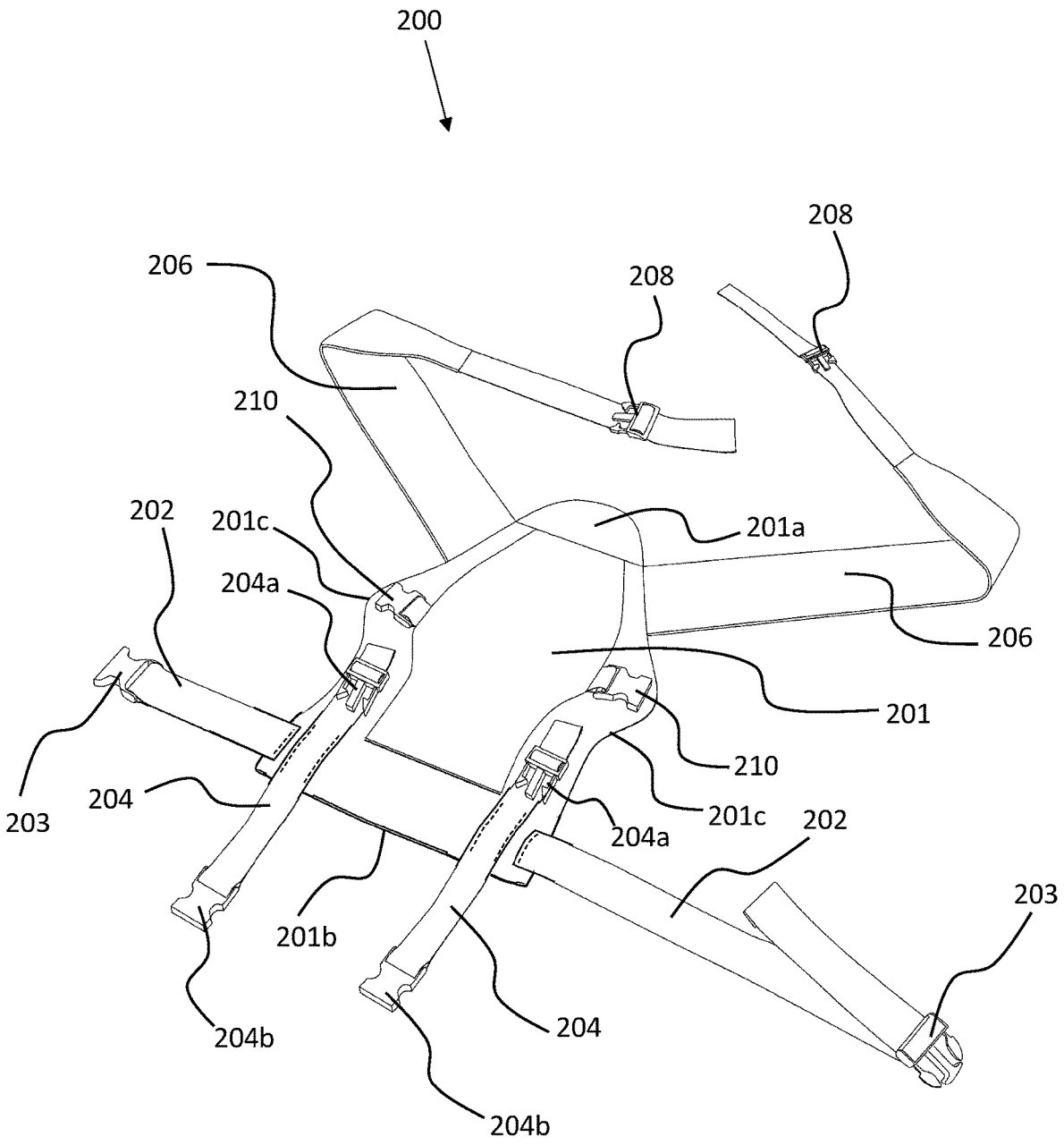
FIG. 1 illustrates a baby carrier device with a waist belt and at least one vertical strap, according to some embodiments of the present invention.

FIG. 1 illustrates a baby carrier device 200 with a waist belt 202 and at least one vertical strap 204, according to some embodiments of the present invention.

The baby carrier device 200 includes a support pad 201, one or more vertical straps 204, and shoulder straps 208. The baby carrier 200 may also include a waist belt 202.

The support pad 201 is configured for receiving and supporting at least an upper body of the baby. When worn, the support pad extends along the upper body of the person carrying the baby. The support pad extends substantially vertically between a top end 201*a* and a bottom end 201*b* thereof, and extends substantially horizontally between lateral sides 201*c* thereof.

The shoulder straps 206 are joined to and extend from the support pad 201. The shoulder straps are configured to removably join the support pad 201 to shoulders of the person carrying the baby.

Figure 6:
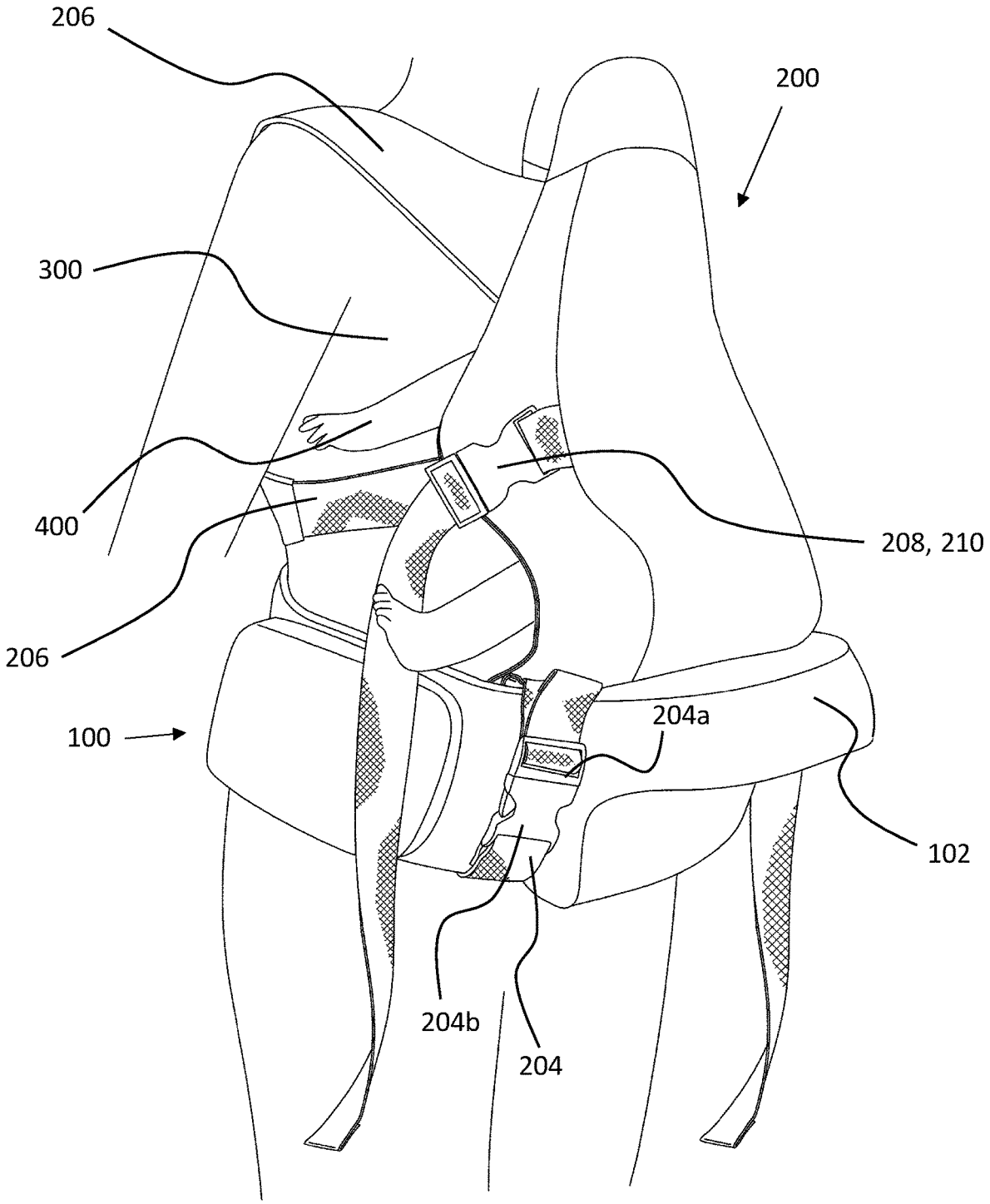
FIG. 6 illustrates a baby carrier device of the present invention worn by a person carrying the baby and removably joined to a hip seat, with the baby located in front of the person carrying the baby and facing the person carrying the baby.

The one or more vertical straps 204 are located at or near the bottom end 201*c* of support pad 201. Each vertical strap has a top portion 204*a* and a bottom portion 204*b*. The bottom portion 204*b* extends below the bottom end 201*b* of the support pad 201. Each vertical strap 204 is configured to encircle a respective portion of a hip seat worn by the person carrying the baby. As shown in FIG. 6, each vertical strap 204 encircles the extension 102 of the hip seat 200, by removably connecting the top portion 204*a* and the bottom portion 204*b* together, to removably join the baby carrier device 200 to the hip seat 100. The top portion 204*a* and the bottom portion 204*b* may include connectors configured to cooperate with each other, while being removable from each other. The connectors may include any kind of known connectors, which include, but are not limited to, clip connectors and loop and hook connectors, for example.

In the embodiments in which the waist belt is present, the waist belt 202 is joined to the support pad 201 at or near the bottom end 201*b* of the support pad 201 and extends horizontally from the lateral sides 201*c* of the support pad 201. The waist belt is configured to encircle a waist of the person carrying the baby in order to removably join a portion of the support pad 201 at or near the bottom end 201*c* to the waist of the person carrying the baby.

In the embodiment of FIG. 1, the waist belt 202 includes two straps extending laterally from each lateral side 201*c*. However, a single long strap having two ends extending laterally way from the lateral sides 201*c* can be used as well.

In the embodiment of FIG. 1, the waist belt 202 and the vertical strap(s) 204 are fixedly joined to the support pad 201, as can be seen by the stitching lines. As will be shown below the examples of FIGS. 2-5, in other embodiments of the present invention the waist belt 202 and the vertical strap(s) 204 are removably joined to the support pad 201.

In some embodiments of the present invention, each shoulder strap 206 includes a respective first connector 208, while the baby carrier device includes two lateral connectors 210 joined to the support pad 201. Each of the first connectors 208 of the shoulder straps 206 is configured is configured to be joined to either lateral connector 210, in order to join the shoulder straps 208 to the shoulders of the person carrying the baby.

As shown in FIGS. 6, 7, 9 and 11, the baby carrier device 102 can be worn so that the support pad is in front of the chest of the person 300 carrying the baby 400.

Figure 7:
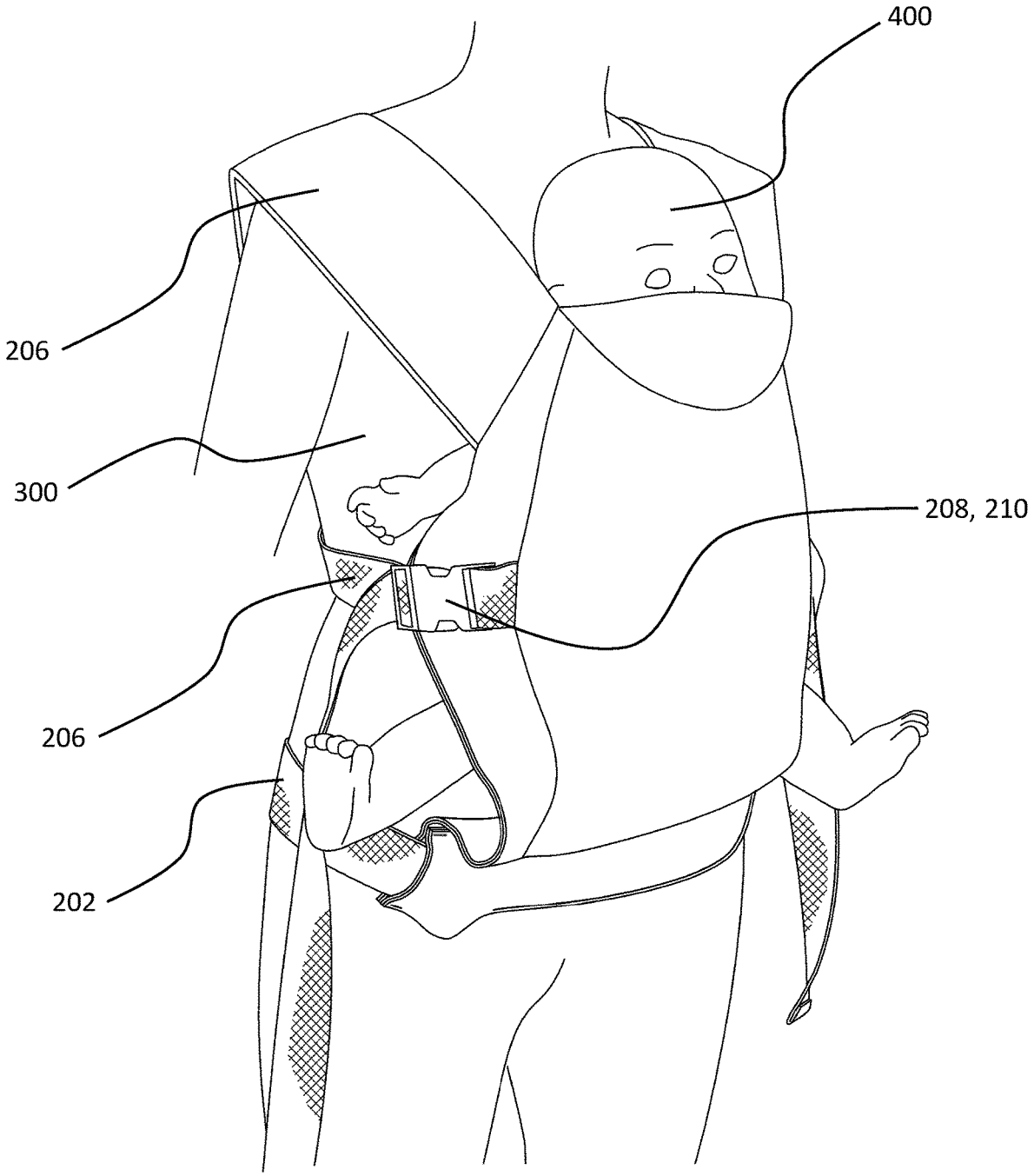
FIG. 7 illustrates a baby carrier device of the present invention worn by a person carrying the baby and removably joined to a heap seat, with the baby located in front the person carrying the baby and facing away from the person carrying the baby.

In the example of FIG. 6, the baby 300 faces the chest the person 300 so that the bottom (buttocks) of the baby 300 is supported by the extension 102 of the hip seat 100. In the example of FIG. 7, the baby 300 faces away from the person 400.

The shoulder straps 206 loop about the shoulders of the person 300 such that each first connector 208 is connected to a lateral connector 210. In the non-limiting example of FIG. 9, it can be seen that each shoulder strap 206 loops around its respective shoulder by crossing diagonally over the back of the person 300 so that the first connector 208 is joined to the lateral connector 210 that is farther from the lateral side that is farther from the shoulder strap 206. In the non-limiting example of FIG. 11, each shoulder strap 206 vertically loops around its respective shoulder without crossing the back of the person 300, so that the first connector 208 is joined to the lateral connector 201 that is closer to the lateral side that is nearer to the shoulder strap 206.

Figure 9:
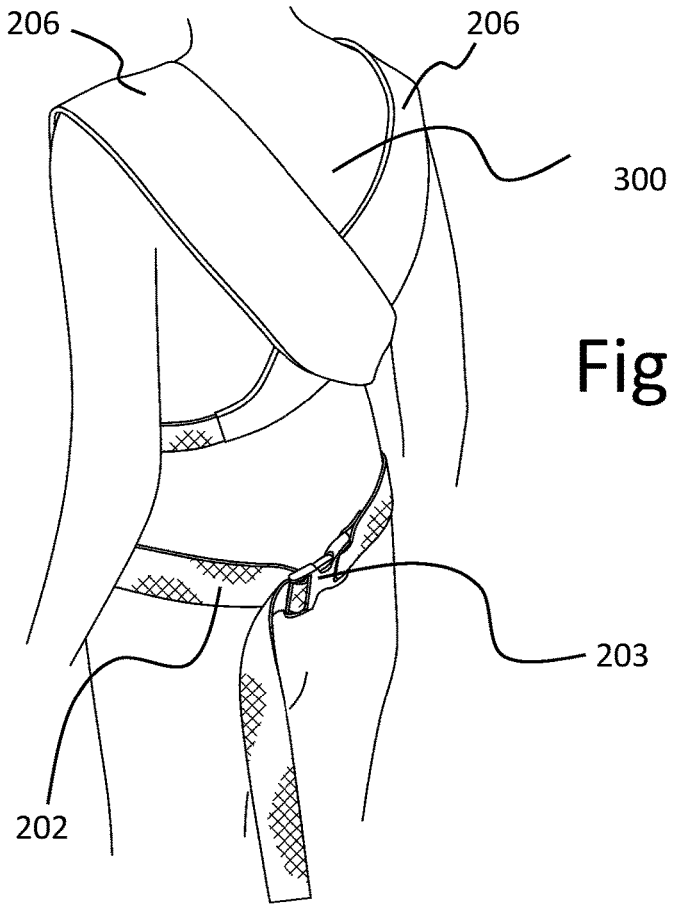
FIG. 9 illustrates a baby carrier device of the present invention, with the shoulder straps crossed at the back of the person carrying the baby, to carry the baby in front of the person carrying the baby.
Figure 10:
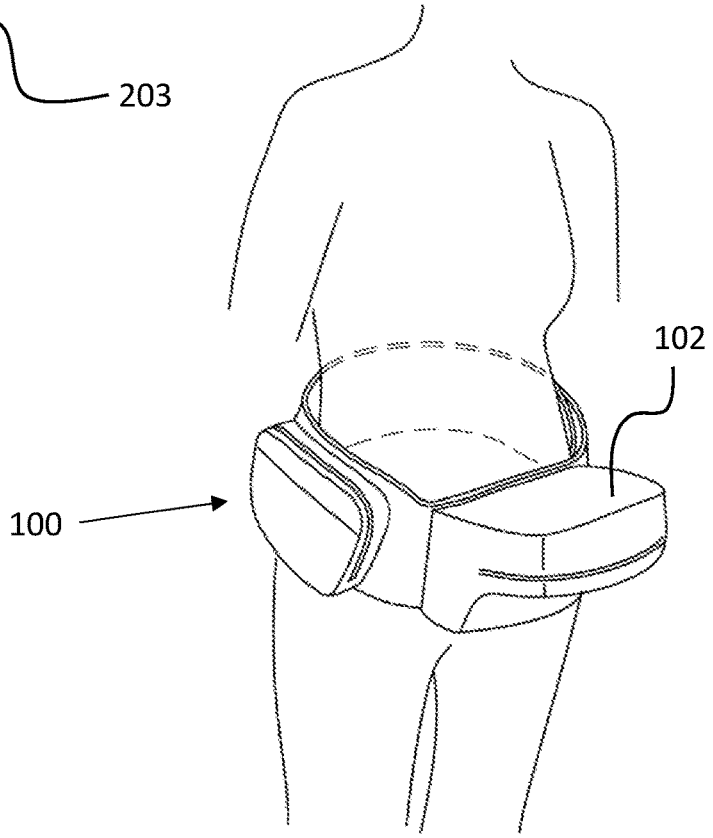
FIG. 10 illustrates a hip seat worn by a person, as known in the general art.
Figure 11:
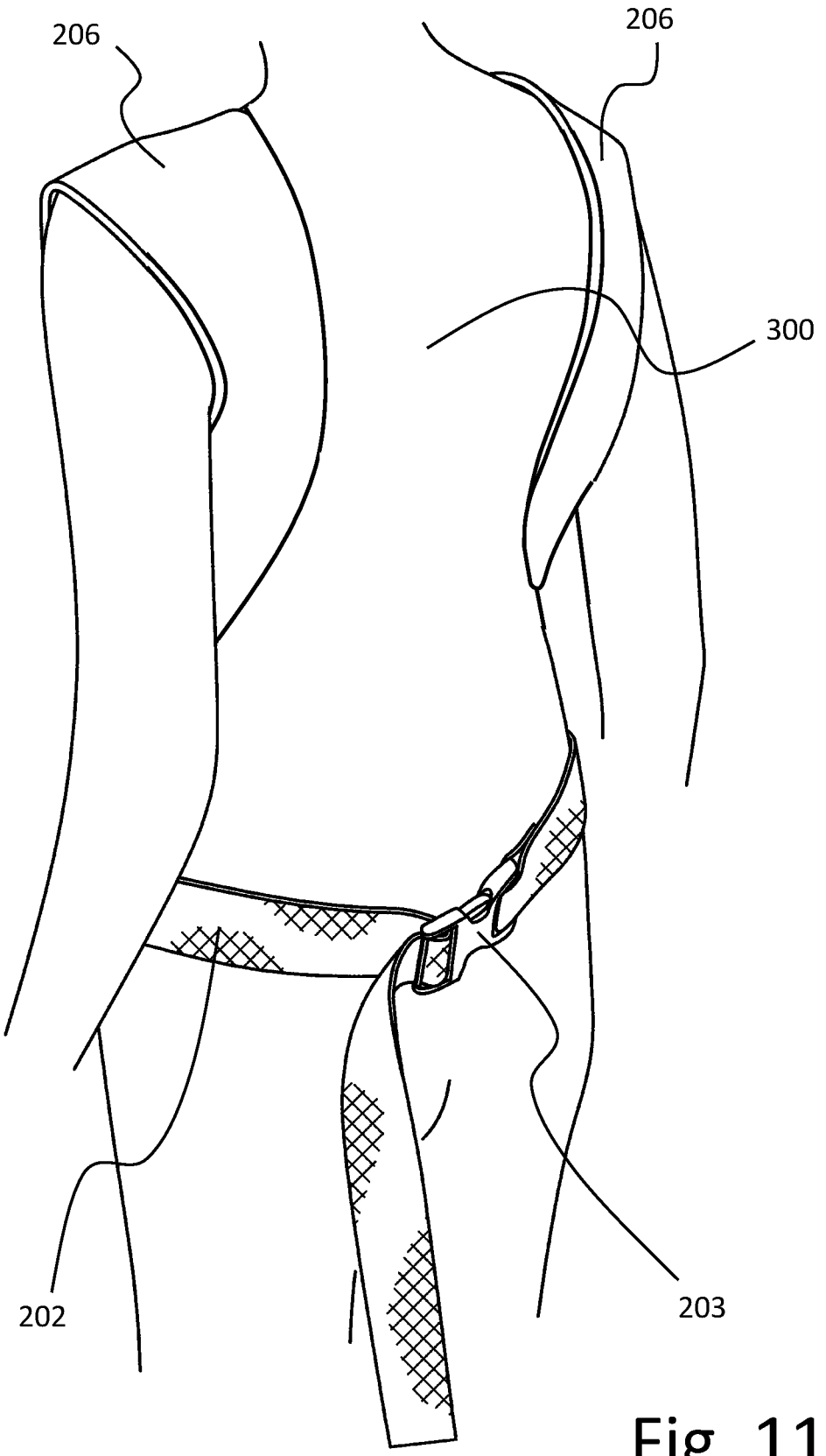
FIG. 11 illustrates a baby carrier device of the present invention, with the shoulder straps looping over the shoulder without crossing at the back of the person carrying the baby, to carry the baby in front of the person carrying the baby.

The waist belt 202 may include connectors 203 at its ends. The connectors 203 connect together to encircle the waist of the person 300, as shown in the examples of FIGS. 9 and 11.

Figure 8:
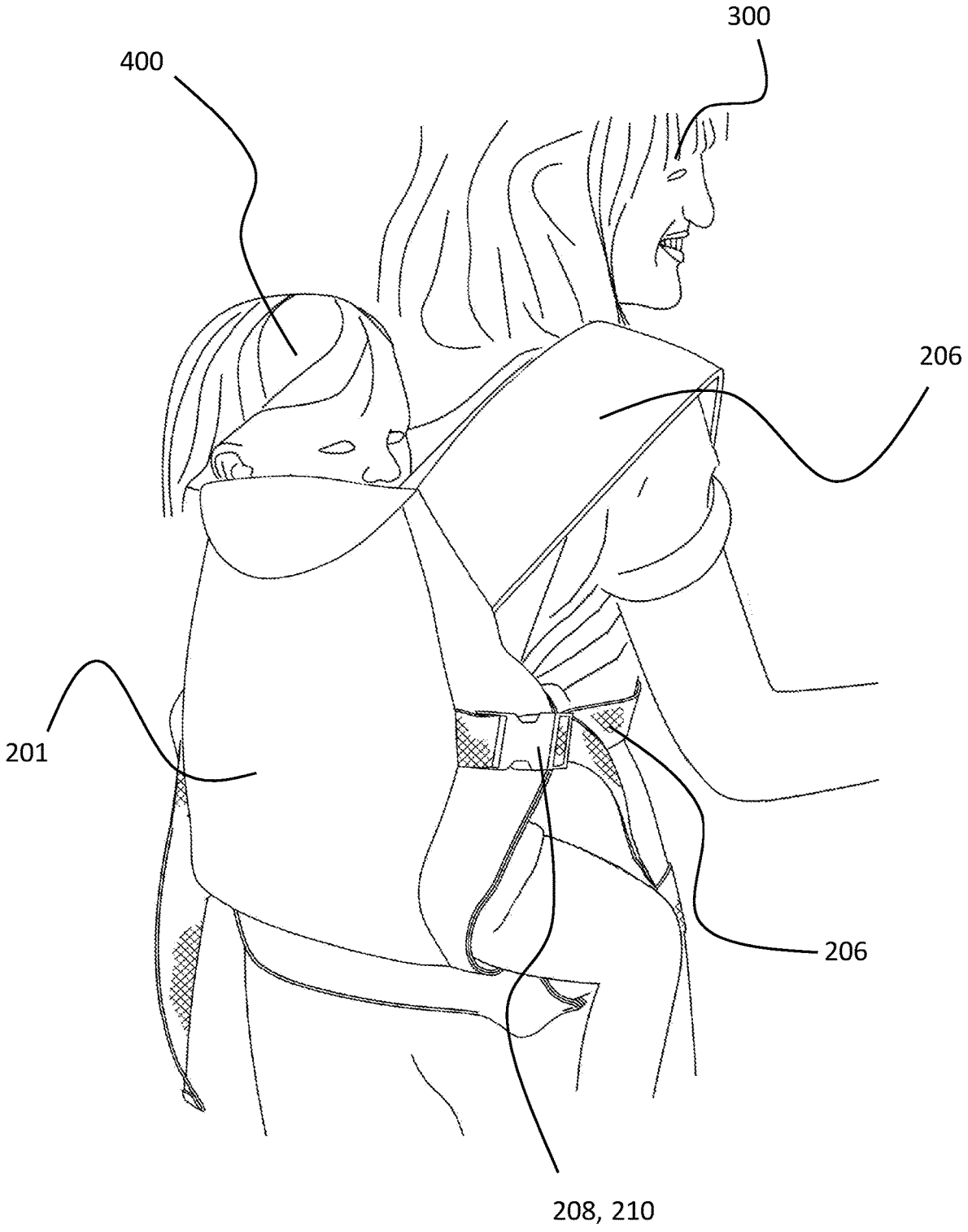
FIG. 8 illustrates a baby carrier device of the present invention worn by a person carrying the baby, with the baby located behind the back of the person carrying the baby.

As shown in FIG. 8, the baby carrier device 102 can be worn so that the support pad 201 is in behind of the person 300 carrying the baby 400.

The baby carrier device 102 is worn as a backpack. That is, each shoulder strap 206 vertically loops around its respective shoulder, so that the first connector 208 is joined to the lateral connector 210 that is closer to the lateral side that is near the shoulder strap 206.

Figure 2:
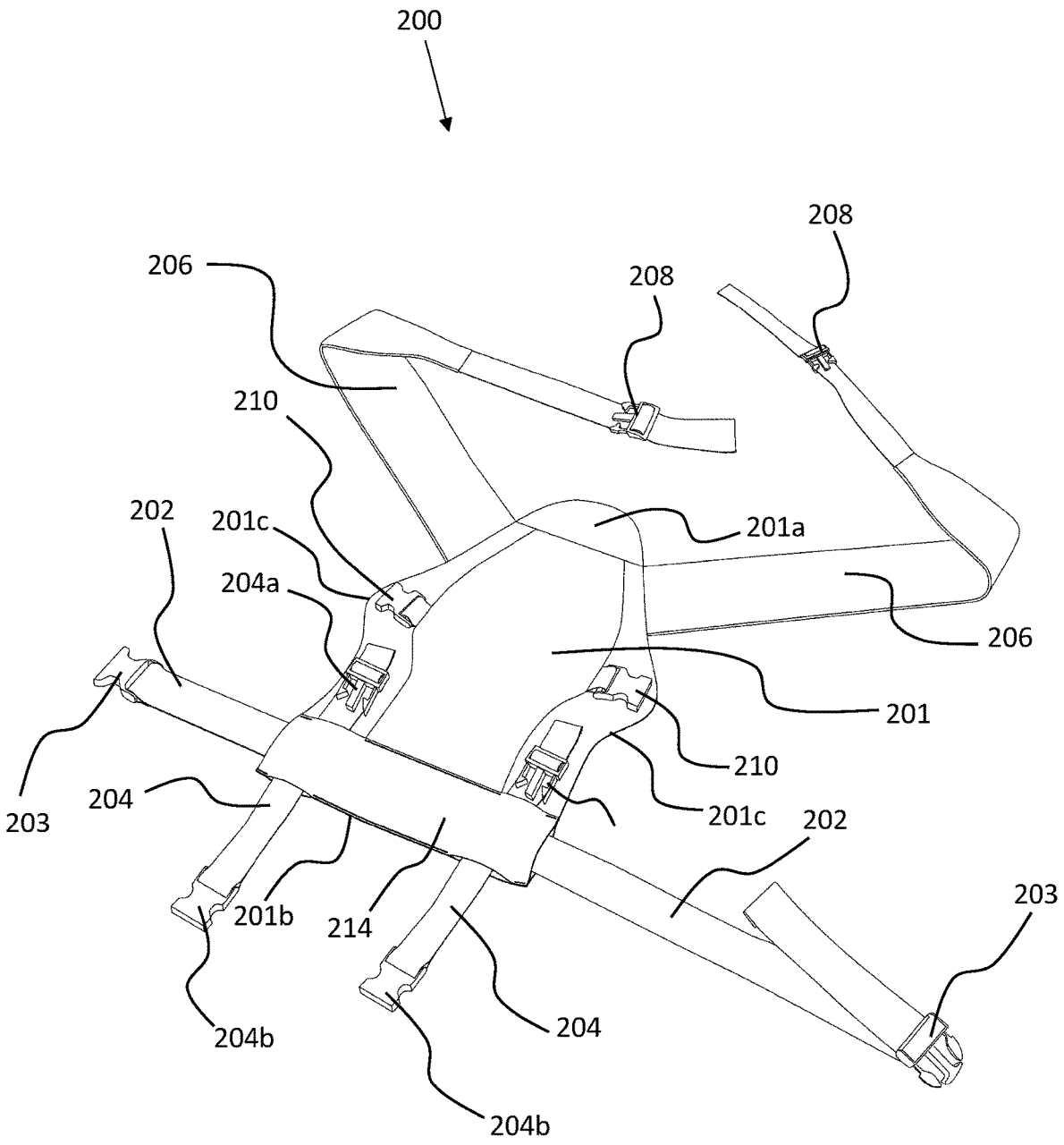
FIG. 2 illustrates a baby carrier device having a horizontal channel traversed by the waist belt and the vertical strap(s), according to some embodiments of the present invention.
Figure 3:
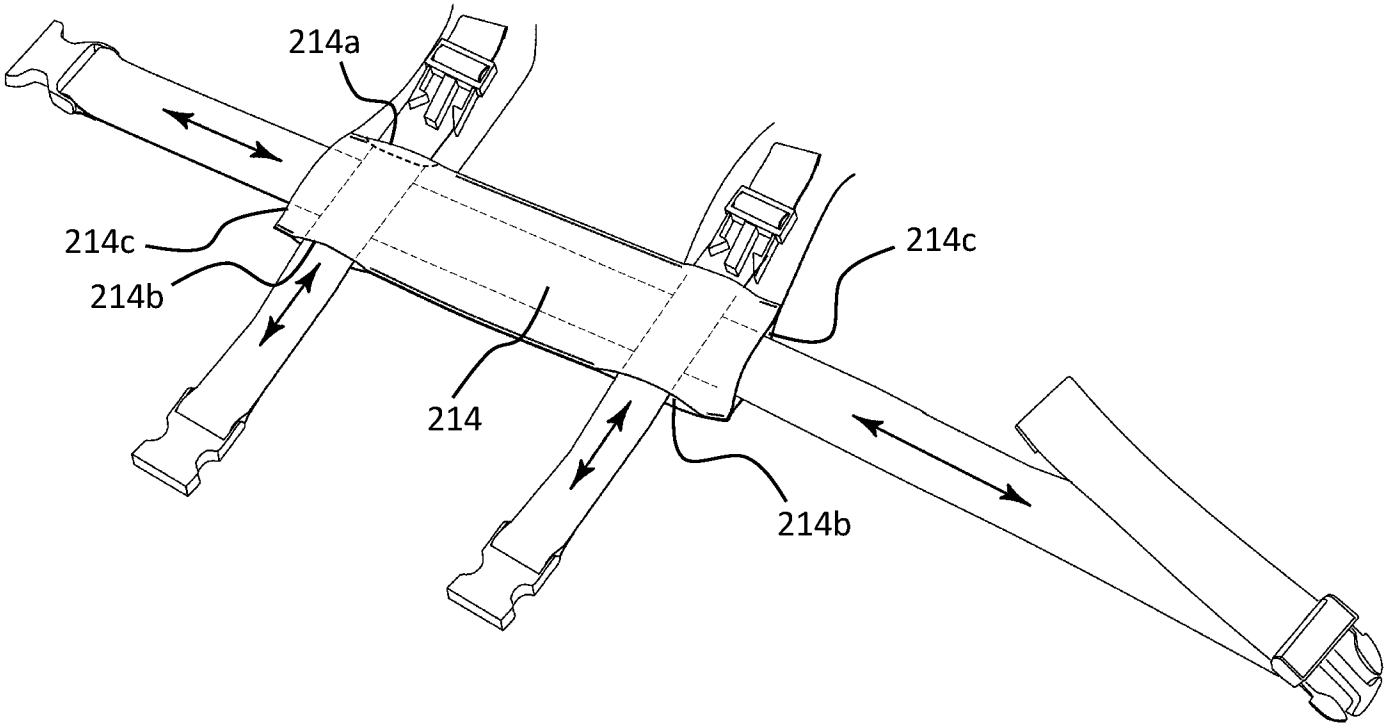
FIG. 3 illustrates a detail of the horizontal channel and the motion of the waist belt and vertical strap(s) relative to the horizontal channel, according to some embodiments of the present invention.

FIG. 2 illustrates a baby carrier device 200 having a horizontal waist channel 214 traversed by the waist belt 202 and the vertical strap(s) 204, according to some embodiments of the present invention. FIG. 3 illustrates a detail of the horizontal channel 214 and the motion of the waist belt 202 and vertical strap(s) 204 relative to the waist channel, according to some embodiments of the present invention.

As mentioned above, the waist belt 202 and/or the vertical strap(s) 204 may be removably joined to the support pad 201.

The advantage of having a removable waist belt is evident when the person 300 wears the baby carrier device 200 with a hip seat 100, as shown in FIG. 6. Since the hip seat already encircles the waist of the person 300, it is unnecessary and uncomfortable for the person 300 to wear the waist belt of the baby carrier device. Since support to the baby's bottom (buttocks) is provided by the extension 102 of the hip seat 100, the waist belt 202 can be removed, while the vertical straps 204 are used to secure the baby carrier device 200 to the hip seat 100. In this manner, the hip seat provides bottom support, while the baby carrier device 201 provides support to the baby's upper body and prevents the baby from falling from the extension 202.

The advantage of having removable vertical straps 204 is evident when the person 300 wears the baby carrier device 200 without a hip seat, as shown in FIG. 7. The waist belt 202 is used for securing the bottom section of the support pad 201 to the waist of the person 300, so that the bottom (buttocks) of the baby 400 are supported from the below by the bottom section of the support pad 201. Since there is no hip seat, the vertical straps would dangle in front of the person 300, which may be uncomfortable. Therefore, removing the vertical straps would be advantageous in this situation.

In some embodiments of the present invention, the baby carrier device 200 includes a horizontal waist channel 214 extending horizontally and located at a bottom portion of the support pad 201, near the bottom end 201*b*. The waist channel 214 has a pair of apertures 214*a* and 214*b* aligned with each other substantially vertically (the top aperture 214*a* being located at about the top of the waist channel and the bottom aperture 214*b* being located below the top aperture 214*a*). The waist channel may additionally include a pair of side openings 214*c* aligned with each other substantially horizontally.

Each pair of apertures 214*a* and 214*b* (if more than one pair is present) is configured to receive and be traversed by a respective vertical strap 204, to removably join the vertical strap to the waist channel 214. Each vertical strap 204 is configured to be removable from the waist channel 214 by sliding via the pair of apertures 214*a* and 214*b*. Each pair of apertures 214*a* and 214*b* effectively forms a respective vertical channel.

The pair of side openings 214*c* (if present) is configured to receive and be traversed by the waist belt 202 (if present), to removably join the waist belt 202 to the waist channel 214. The waist belt 202 is configured to be removable from the waist channel 214 by sliding via the pair of side openings 214*c*.

In the example of FIGS. 2 and 3, the top aperture 214*a* is located at the top of the waist channel 214, the bottom aperture 214*b* is located at the bottom of the waist channel 214, while the side openings 214*c* are located at the lateral ends of the waist channel 214. But these constraints are not necessary.

Figure 4:
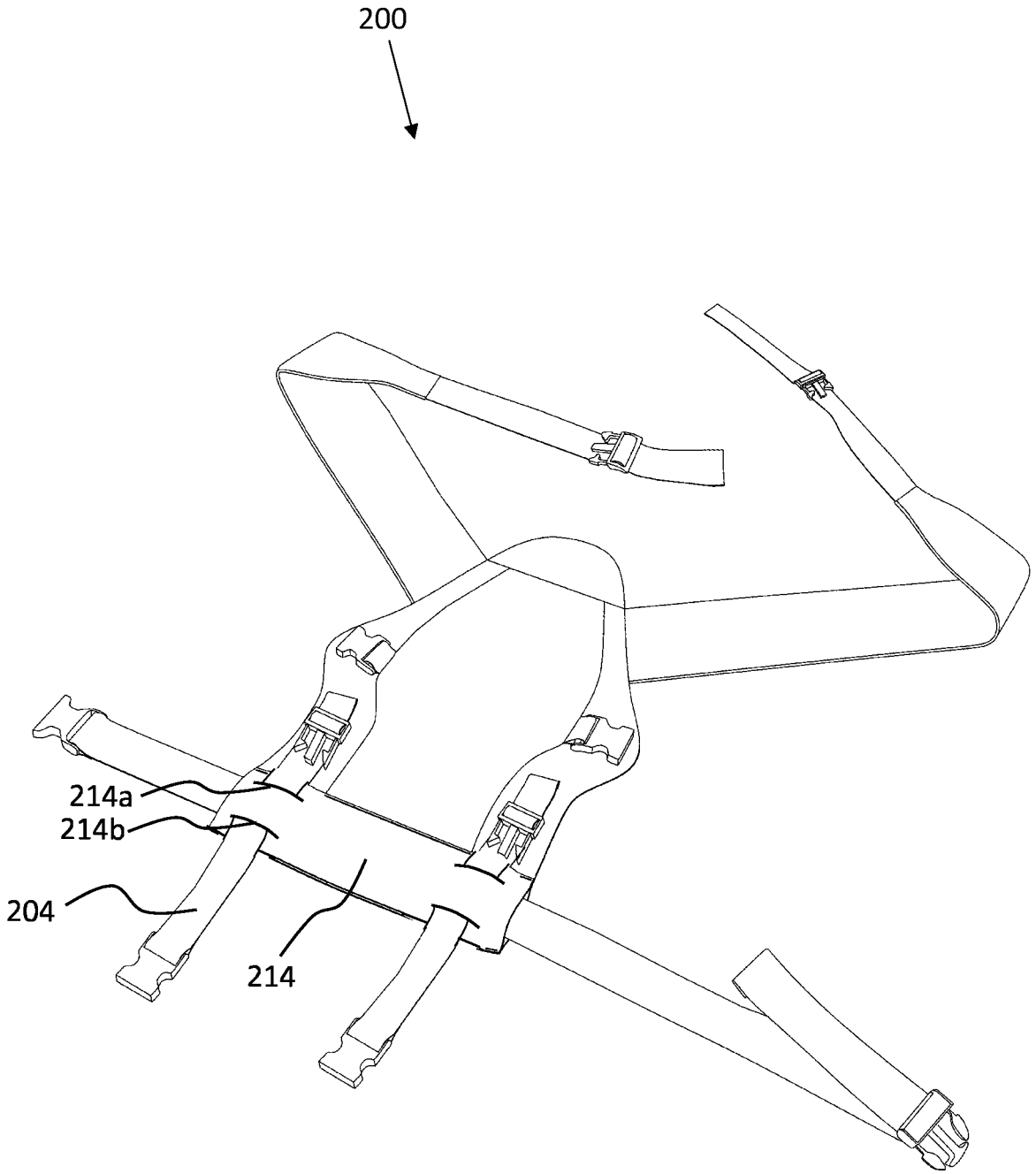
FIG. 4 illustrates a baby carrier device in which the apertures on the horizontal channel for being traversed by the vertical straps are not at the top and bottom edges of the horizontal channel, according to some embodiments of the present invention.

In the example of FIG. 4, the top aperture 214*a* is located below the top of the waist channel 214, while the bottom aperture 214*b* is located above the bottom the waist channel 214. What remains constant is the fact that the top aperture 214*a* is located above the aperture 214*b*, and is substantially vertically aligned with the bottom aperture 214*b*. In this manner, a vertical strap 204 traversing the pair of apertures 214*a* and 214*b* can be retained inside the waist channel 214 in a vertical orientation, and can be removable from the waist channel 214 via the pairs of the apertures 214*a* and 214*b*.

Figure 5:
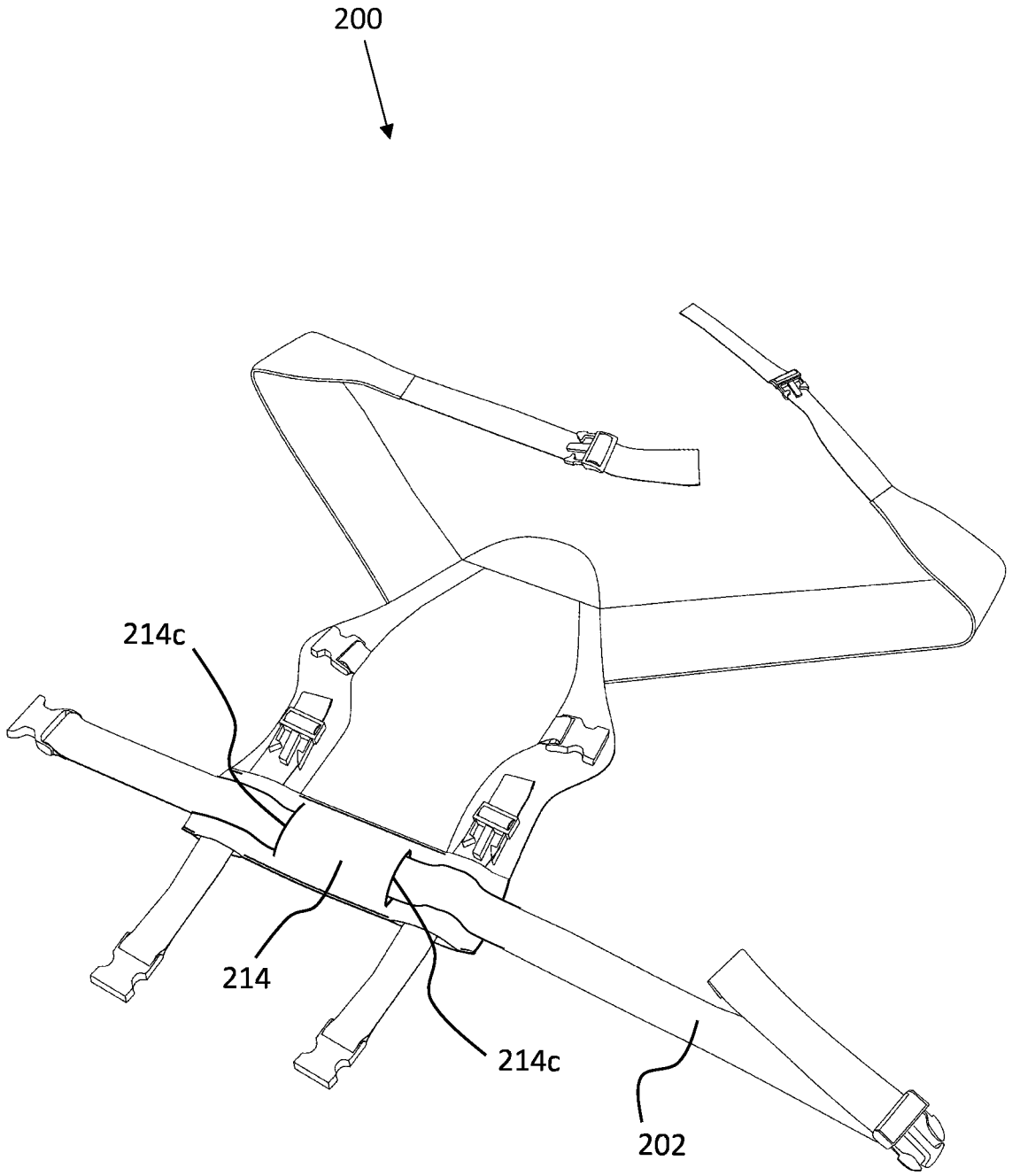
FIG. 5 illustrates a baby carrier device in which the apertures on the horizontal channel for being traversed by the waist belt are not at the lateral sides of the horizontal channel, according to some embodiments of the present invention.

In the example of FIG. 5, the side openings 214*c* are more centered and not on the lateral sides of the waist channel 214. What remains constant is the fact that the side openings 214*c* are aligned with each other substantially horizontally. In this manner, the waist belt 202 traversing the side openings 214*c* can be retained inside the waist channel 214 in a horizontal orientation, and can be removable from the waist channel 214 via the pair of side openings 214*c*.

Figure 12:
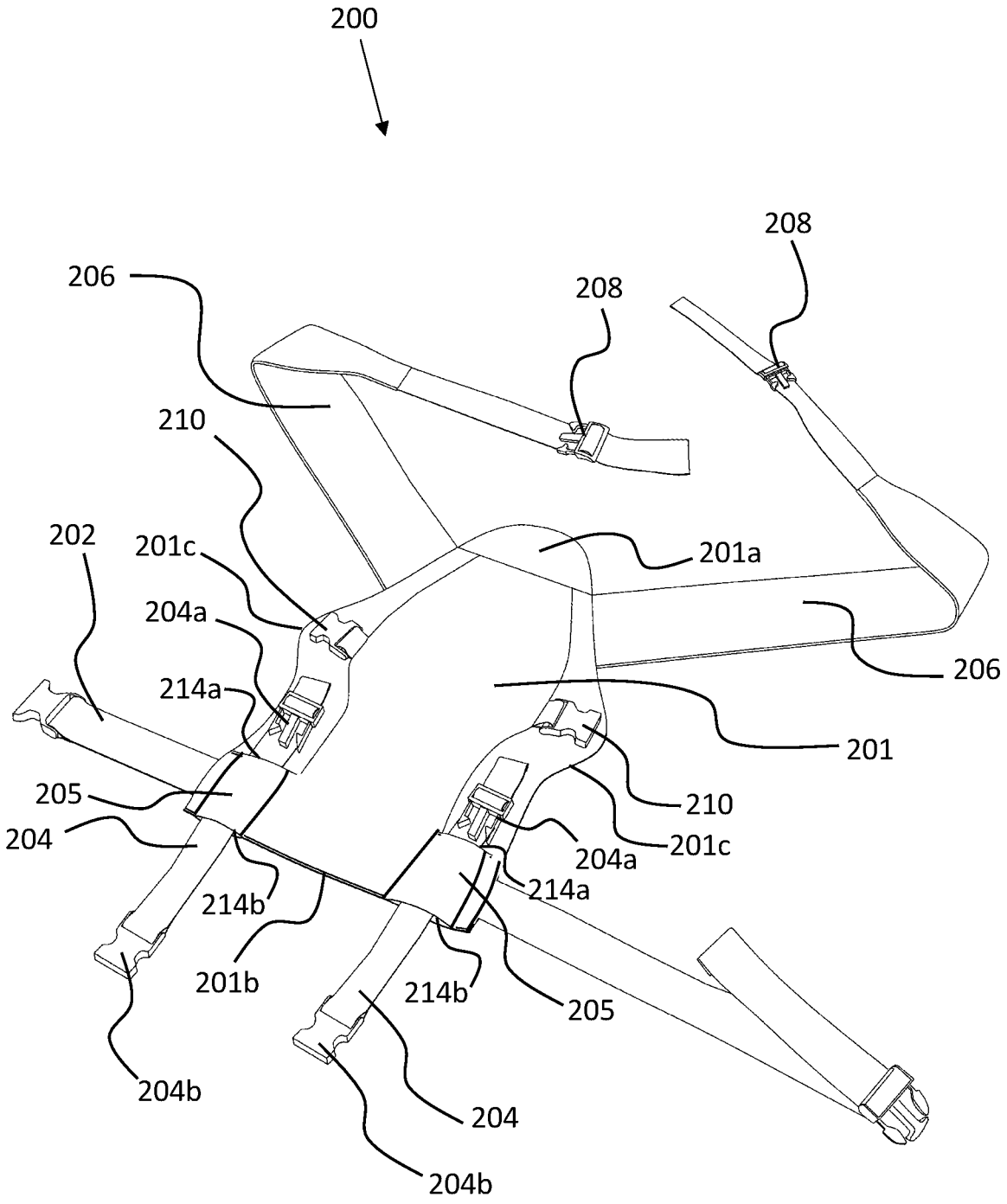
FIG. 12 illustrates a baby carrier with one or more vertical channels, according to some embodiments to the present invention.

In some embodiments of the present invention, as shown in FIG. 12, one or more vertical channels 205 are located near at the bottom of the support pad 201. Each vertical channel 205 has a top aperture 214*a* and a bottom aperture 214*b* located substantially below the top aperture 214*a*. Each vertical channel 205 is traversed by a respective vertical strap 204 described below. The waist belt 202 may or may not be included, and may or may not be removable. According to some embodiments of the present invention, each vertical channel 204 is removable from the respective vertical channel 205, by being slid in or out via the bottom aperture 214*b* and the top aperture 214*a*.

What is claimed is:

1. A baby carrier device configured to be worn by a person to secure a baby an upper body of the person, the baby carrier device comprising:

a support pad configured for receiving and supporting at least an upper body of the baby, the support pad extending vertically between a top end and a bottom end thereof and extending horizontally between lateral sides thereof;

shoulder straps joined to the support pad, the shoulder straps being configured to removably join the support pad to shoulders of the person carrying the baby;

at least one vertical strap located at or near the bottom of support pad, the vertical strap having a top portion and a bottom portion, the bottom portion extending below the bottom end of the support pad, the vertical strap being configured for encircling a portion of a hip seat worn by the person carrying the baby by removably connecting the top portion to the bottom portion, to removably join the baby carrier device to the hip seat, and a waist channel extending horizontally and located at a bottom portion of the support pad, the waist channel having at least a first top aperture and first bottom aperture, the first bottom aperture being located below the first top aperture;

wherein the at least one vertical strap is disposed in the waist channel; and wherein the at least one vertical strap is configured to be removable from the waist channel via the first top aperture and/or the second aperture;

wherein the first top aperture and the first bottom aperture form a vertical channel traversed by the at least one vertical strap.

2. The baby carrier device of claim 1, wherein:

the waist channel has a second top aperture and second bottom aperture, the second bottom aperture being located below the second top aperture;

the baby carrier device comprises a second vertical strap dispose in the waist channel;

the second vertical strap is configured to be removable from the waist channel via the second top aperture and/or the second bottom aperture;

the second top aperture and the second bottom aperture form a second vertical channel traversed by the second vertical strap.

3. The baby carrier device of claim 1, wherein the at least one vertical strap comprises a plurality of vertical straps.

4. The baby carrier device of claim 1, comprising a waist belt joined to the support pad at or near the bottom end of the support pad, the waist belt extending horizontally from the lateral sides of the support pad and being configured to encircle a waist of the person carrying the baby in order to removably join a portion of the support pad at or near the bottom end to the waist of the person carrying the baby.

5. The baby carrier device of claim 1, comprising lateral connectors joined to the support pad;

wherein the shoulder straps comprise respective first connectors;

wherein each of the first connectors of the shoulder straps is configured to be joined to either lateral connector, to join the shoulder straps to the shoulders of the person carrying the baby.

6. The baby carrier device of claim 5, wherein each shoulder strap is near a respective lateral side, and the first connector of each shoulder strap is configured to be joined to the lateral connector closer to the lateral side of the shoulder strap, so as to create a closed loop over a corresponding shoulder of the person carrying the baby.

7. The baby carrier device of claim 5, wherein each shoulder strap is near a respective lateral side, and the first connector of each shoulder strap is configured to be joined to the lateral connector farther from the lateral side of the shoulder strap, so as to create a closed loop over a back of the person carrying the baby.

8. A baby carrier device configured to be worn by a person to secure a baby an upper body of the person, the baby carrier device comprising:

a support pad configured for receiving and supporting at least an upper body of the baby, the support pad extending vertically between a top end and a bottom end thereof and extending horizontally between lateral sides thereof;

shoulder straps joined to the support pad, the shoulder straps being configured to removably join the support pad to shoulders of a person carrying the baby;

at least one vertical strap located at or near the bottom end of support pad, the vertical strap having a top portion and a bottom portion, the bottom portion extending below the bottom end of the support pad, the vertical strap being configured for encircling a portion of a hip seat worn by the person carrying the baby by removably connecting the top portion to the bottom portion together, to removably join the baby carrier device to the hip seat;

a waist belt joined to the support pad at or near the bottom end of the support pad, the waist belt extending horizontally from the lateral sides of the support pad and being configured to encircle a waist of the person carrying the baby in order to removably join a portion of the support pad at or near the bottom end to the waist of the person carrying the baby;

a waist channel extending horizontally and located at a bottom portion of the support, the waist channel having at least a first top aperture, first bottom aperture, a first side opening and a second side opening;

wherein the first top aperture is located above the first bottom aperture;

wherein the first top aperture and the first bottom aperture form a first vertical channel;

wherein the first side opening and the second side opening horizontally aligned with each other;

wherein the at least one vertical strap traverses the first vertical channel via the first top aperture and the first bottom aperture; and wherein the at least one vertical strap is removable from the waist channel via the first top aperture and/or the second aperture;

wherein the waist belt traverses at least a portion of the waist channel via the first side opening and the second side opening;

wherein the waist belt is removable from the waist channel via the first side opening and the second side opening.

9. The baby carrier device of claim 8, wherein:

the waist channel has a second top aperture and second bottom aperture, the second bottom aperture being located below the second top aperture;

wherein the first top aperture and the first bottom aperture form a second vertical channel;

the baby carrier device comprises a second vertical strap traversing second vertical channel via the second top aperture and the second bottom aperture; and the second vertical strap is removable from the waist channel via the second top aperture and/or the second aperture.

10. The baby carrier device of claim 8, wherein the first side opening is at a first lateral end of the waist channel and the second side opening is at a second lateral end of the waist channel.

11. A baby carrier device configured to be worn by a person to secure a baby an upper body of the person, the baby carrier device comprising:

a support pad configured for receiving and supporting at least an upper body of the baby, the support pad extending vertically between a top end and a bottom end thereof and extending horizontally between lateral sides thereof;

shoulder straps joined to the support pad, the shoulder straps being configured to removably join the support pad to shoulders of a person carrying the baby;

at least one vertical strap located at or near the bottom end of support pad, the vertical strap having a top portion and a bottom portion, the bottom portion extending below the bottom end of the support pad, the vertical strap being configured for encircling a portion of a hip seat worn by the person carrying the baby by removably connecting the top portion to the bottom portion together, to removably join the baby carrier device to the hip seat;

a vertical channel located at a bottom portion of the support pad, the vertical channel having at least a first top aperture and a first bottom aperture;

wherein the first top aperture is located above the first bottom aperture;

wherein the at least one vertical strap is disposed in and traverses the vertical channel via the first top aperture and the first bottom aperture; and wherein the at least one vertical strap is removable from the vertical channel via the first top aperture and/or the second aperture.

* * * * *